US009246224B2

(12) United States Patent
Lalezari

(10) Patent No.: US 9,246,224 B2
(45) Date of Patent: Jan. 26, 2016

(54) BROADBAND ANTENNA SYSTEM ALLOWING MULTIPLE STACKED COLLINEAR DEVICES AND HAVING AN INTEGRATED, CO-PLANAR BALUN

(75) Inventor: Farzin Lalezari, Boulder, CO (US)

(73) Assignee: FIRST RF Corporation, Boulder, CO (US)

( * ) Notice: Subject to any disclaimer, the term of this patent is extended or adjusted under 35 U.S.C. 154(b) by 693 days.

(21) Appl. No.: 13/360,426

(22) Filed: Jan. 27, 2012

(65) Prior Publication Data

US 2012/0188137 A1 Jul. 26, 2012

Related U.S. Application Data

(63) Continuation-in-part of application No. 12/408,259, filed on Mar. 20, 2009, now Pat. No. 8,228,257.

(60) Provisional application No. 61/064,725, filed on Mar. 21, 2008.

(51) Int. Cl.
*H01Q 21/20* (2006.01)
*H01Q 9/28* (2006.01)
*H01Q 21/10* (2006.01)

(52) U.S. Cl.
CPC . *H01Q 9/28* (2013.01); *H01Q 21/10* (2013.01)

(58) Field of Classification Search
USPC ..... 343/799
See application file for complete search history.

(56) References Cited

U.S. PATENT DOCUMENTS

2006/0250306 A1 * 11/2006 Ryken et al. ..... 343/700 MS

FOREIGN PATENT DOCUMENTS

WO WO 2006096866 A2 * 9/2006

OTHER PUBLICATIONS

"Antenna Theory: A Review," Balanis, Proc. IEEE vol. 80 No. 1 Jan. 1992.*
Antenna Theory, Analysis and Design, third edition, Constantine Balanis, John Wiley and Sons, 2005, p. 70.*

* cited by examiner

*Primary Examiner* — Graham Smith
(74) *Attorney, Agent, or Firm* — IntelleTech, PLLC; Katharine I. Matthews

(57) ABSTRACT

A broadband antenna system is disclosed. The antenna system relates to a cylindrical structure, wherein the feed region comprises segmented radiators with tapered feed points, distributed around the circumference of the structure, and a balun that is co-planar with the cylindrical structure. This allows a plurality of feed lines, cables, piping, or other structures to be run through the center of the antenna without interfering with the performance of the antenna system. Segmentation of the radiators permits the integration of a corporate feed network, suppresses overmoding, and permits operation without the need for a ground plane. The invention further relates to a stacked broadband antenna system wherein additional antenna elements or devices may be stacked collinearly on the antenna structure and operated via the plurality of feed lines or other structures. The overall system thus provides a wide range of transmitting, receiving, sensing and other capabilities over a virtually infinite bandwidth.

18 Claims, 10 Drawing Sheets

BROADBAND ANTENNA SYSTEM ALLOWING MULTIPLE STACKED COLLINEAR DEVICES AND HAVING AN INTEGRATED, CO-PLANAR BALUN

CROSS REFERENCE TO RELATED APPLICATIONS

This application is a Continuation-in-part of and claims the benefit of prior-filed U.S. Nonprovisional application for patent Ser. No. 12/408,259 filed on 20 Mar. 2009, now U.S. Pat. No. 8,228,257 entitled "Broadband Antenna System Allowing Multiple Stacked Collinear Devices," which in turns claims priority from U.S. Provisional Application for Patent Ser. No. 61/064,725 filed on 21 Mar. 2008, entitled "Modified Conical Antenna System Allowing Multiple Stacked Collinear Elements," both of which are incorporated herein by reference in their entireties.

FIELD OF THE INVENTION

The present invention relates to a broadband antenna system, and more particularly, to a modified conical antenna structure wherein the feed region is cut away to form a substantially cylindrical shape termed herein "coneless." The enlarged feed region and distribution of tapered feed points around the circumference of the "coneless" cylinder permit the collinear and coaxial stacking of multiple antenna elements or other devices. In particular, segmentation of the radiators permits the integration of a corporate feed network and suppresses overmoding. Further, the design of the integrated, co-planar balun and feed network, formed on a printed circuit board that may be rolled into a cylindrical or other shape, provides improved performance and reduces manufacturing cost. The integrated, co-planar balun and feed network permit the antenna system of the present invention to operate without a ground plane. The additional antennas or other devices may be disposed within or stacked on the antenna structure without interfering with the performance of the antenna system, thus providing a wide range of sensing, transmitting, receiving and other capabilities for the overall system. Multiple feed lines, cables, piping, tubing or other structures may be run through the hollow center of one or more coneless elements to feed, power or operate the stacked devices. By combining one or more coneless elements with other antennas, the antenna system of the present invention may provide a virtually infinite bandwidth.

BACKGROUND OF THE INVENTION

Monocone and bicone (also termed biconical herein) antennas are well-known in the art. Many variations on the basic design of the monocone (cone, feed and ground plane) and bicone (pair of cones, feed and balun, with or without ground plane) are known. Applicant has developed an innovative "coneless" design that provides comparable or better performance relative to the known monocone and bicone antennas. The coneless design preserves the desirable performance of a conical antenna, but achieves advancement in antenna capability that has been desired, but not realized, for many years. The present invention is a simple, robust and inexpensive multifunctional antenna system that provides high gain over a large bandwidth. The innovative shape of the feed region of the present invention, having "tapered feed points" disposed substantially at the circumference of the antenna structure, opens up the typical conic tip region of known monocone and bicone designs. The one or more tapered feed points replace the single feed/single conic tip that typically feeds known monocone antennas or the single feed/two conic tips of known bicone antennas. In addition, the antenna's radiating portion is divided into two or more separate segments, each having a tapered feed point, which suppresses coupling. For optimal performance, the circumferential spacing of the tapered feed points is less than half a wavelength at the highest frequency of operation.

The present invention improves the feed network of Applicant's prior design (co-pending U.S. patent application Ser. No. 12/408,259, assigned to Assignee of the present invention) the entirety of which is incorporated herein by reference. The integrated feed network of the present invention use multiple coneless radiating elements in a coordinated excitation to form a beam, similar to that disclosed in Applicant's co-pending U.S. patent application Ser. No. 12/408,259, however the integrated feed network is provided on a rolled printed circuit board that is co-planar with and integrated with the circumference of the antenna structure, instead of centrally located within the structure. The present invention discloses a substantially cylindrical structure, however, the shape may be that of any closed surface, such as an ellipse, rectangle or square.

As Applicant disclosed in co-pending U.S. patent application Ser. No. 12/408,259, achieving an omni-directional high gain radiation pattern required an array of elements. Exciting this array of elements required a feed network that was challenging to implement such that it did not impact the radiation performance of the antenna. This problem was addressed by using the coneless element design with a power divider at the base, as disclosed in Applicant's co-pending U.S. patent application Ser. No. 12/408,259. Power cables were routed from the power divider up through the coneless elements, in the center of the cylinder, which prevented the network from interfering with the radiating elements and thus allowed a stack of coneless antennas to be excited. At higher frequencies, and in some challenging form factors, however, the size of the coneless elements themselves becomes too small in diameter to practically allow cables and components to be routed to the elements. In such cases, dividing the radiating portion into two or more segments suppresses overmoding and permits the integration of a corporate feed network. The integrated, co-planar feed network of the present invention provides a reactive corporate network that excites the elements with less limitation to frequency of operation. Indeed, the assembly of closely spaced radiator segmentations operates essentially as one radiator at a larger diameter. As a result, for antenna structures less than $1\lambda$ in diameter, the present invention provides a bandwidth of at least 3:1, compared with a bandwidth of 2:1 in Applicant's prior design disclosed in co-pending U.S. patent application Ser. No. 12/408,259. The improved design of the present invention allows an array of multiple elements without the need for various internal cables and power dividers, because the integrated network provides the function of these components. Alternatively, the design of the present invention may also be used with internal cables and power dividers to allow the stacking of additional integrated balun antenna elements and other devices. A center pipe may be provided within the antenna structure to route the various internal cables and keep the cables optimally oriented, thereby improving performance.

The integrated network of the present invention may be manufactured at a lower cost, because fewer overall components are used to achieve the same performance. In addition, the rolled printed circuit board of the present invention provides ease of manufacture of the feed network, higher quality control and greater reliability.

In order to improve bandwidth coverage, as well as gain, it is well-known to combine multiple antennas. Applicant has previously disclosed an ultra-broadband antenna system (U.S. Pat. No. 7,339,542, assigned to Assignee of the present invention) that combines an asymmetrical dipole (covering intermediate frequencies), fed with a biconical dipole (covering high frequencies), that together act as a monopole (covering low frequencies), all in a single tubular structure. The design of U.S. Pat. No. 7,339,542, including the use of a choke to limit interference, resulted in an ultra-broadband antenna system with a frequency span greater than 500:1. Nonetheless, this antenna system was limited by the very small opening in the conic tips of the biconical dipole, which resulted in coupling and interference. In order to combine additional elements with this ultra-broadband antenna system, Applicant has applied the coneless shape of the hereindescribed monocone to the biconical antenna element. The cut-away or shaped design of the feed region of the present invention opens up the typical "cone" of the prior art conical antennas, making a larger opening in the center of the antenna structure. Indeed, the diameter of the coneless element is substantially as large as that of the cylinder of the tubular antenna structure. This allows antenna feed lines or a wide variety of cables, such as coaxial, power, digital, fiber optic, wire, etc., as well as piping, tubing, actuators or other structures, to be run through the center of the antenna with minimal to no interference with the standalone antenna performance. For the biconical antenna of the present invention, the coneless elements may be aligned, or the elements may be clocked to improve performance in azimuth.

Another approach to providing wider bandwidth and improving gain has been to stack biconical radiators. Those skilled in the art have long studied the cone angle, overall length of the antenna, and diameter of the biconical elements in attempts to provide impedance matching of the antenna elements. An unsolved problem has been providing the feed to the stacked biconical structures without interfering with the RF performance of the lower biconical element. The innovative design of the present invention provides the same impedance matching and RF performance of known single feed point biconical structures, by positioning the one or more tapered feed points on the circumference of the cylindrical feed region. Stacking two coneless biconical elements results in higher gain at a given bandwidth; the present invention allows stacking of three, four or even more coneless biconical elements, for even higher gain, which provides the advantages of both increased range and reduced power requirements. To provide a wider frequency range, elements of differing diameters and/or differing length may also be stacked, without degradation in performance of the individual elements. At the same time that it provides greater bandwidth and/or higher gain, the innovation of present invention can allow reduction in the size of the antenna system, such as height, footprint, or diameter, or allow the system to be made conformal.

Thus, the innovative design of the coneless elements not only provides the physical space for feed lines either to be run through the center of the tubular antenna structure, or to be integrated and co-planar with the antenna cylinder, it also allows a wide range of devices to transmit and receive RF, audio, video and other optical frequencies, or other signals without interfering with the performance of the antenna system. In addition, non-electrical feeds, such as hydraulic, pneumatic and mechanical controls or actuators, and gas, liquid or solid material transfer systems, may also be run through the center of the antenna without degrading performance. The innovation of the present invention thus has many practical applications. Devices such as cameras, IR sensors, GPS devices, lights, audio equipment, radar equipment and communications equipment all may be mounted on the top of a multiple element, tubular antenna system that has a relatively small footprint. Where preferable, such devices may also be mounted in between multiple antenna elements. In many situations, this may obviate the need for multiple (separate) antennas, which otherwise would have to be placed apart in order not to interfere with each other.

By allowing the collinear and coaxial stacking of multiple antennas, the present invention is able to provide an antenna system with virtually unlimited bandwidth. Further, the present invention allows for both directional and omni-directional coverage, depending on the type of antennas combined.

Applications for the present invention, allowing for a wide variety of multiple stacked antennas and/or other devices, include placement on land vehicles, ships, planes, helicopters or spacecraft; land-based or sea-based locations; as well as man-portable uses.

The known art of antennas is voluminous. Applicant believes that the present invention may distinguished from the relevant prior art as follows. Typical known conical and biconical antennas, exemplified by the work of Carter, such as U.S. Pat. No. 2,175,252, disclose a single conical feed point that excites the cone-shaped radiator, which may be a single cone disposed above ground, or two cones about the same axis forming a bicone. The conical shape provides an impedance appearing almost as a pure resistance, or has no reactive component with variation in frequency, thus is useful over a wide frequency range. U.S. Pat. No. 2,416,698 to King discloses a single biconical with one feed point, having a hollow central cylinder. U.S. Pat. No. 2,543,130 to. Robertson discloses yet another early biconical antenna, having a hollow pipe guide connected to a horn-shaped radiator for improved impedance matching. Like the present invention, monocones and bicones give broadband performance. Unlike the present invention, however, the foregoing designs do not permit the stacking of multiple antenna elements or other devices, because feed lines or cables cannot be run from the hollow central elements through the feed region without causing interference.

Another type of known antenna which does permit stacked collinear elements employs a traveling wave feed system. U.S. Pat. No. 2,471,021 to Bradley discloses a plurality of stacked biconical horn antennas, which use a driving network to couple into a circular wave guide through symmetrically arranged slots. U.S. Pat. No. 3,605,099 to Griffith discloses an antenna with stacked pairs of frustoconical reflector elements attached to a central hollow support member containing a central conductor. Feed is via traveling wave transmission through slots, connecting adjustable probes between the slots and the central conductor. U.S. Pat. No. 4,225,869 to Lohrmann discloses a multicone antenna having ¼ wavelength cones at each slot of a slotted ring antenna. U.S. Pat. No. 6,593,892 to Honda et al. discloses stacked biconical elements with a single center feed line. This class of antennas can be relatively broadband, and permit stacking of collinear biconical elements. The feed method of such systems is fundamentally different from that of the present invention, however, as the traveling wave is not an independent direct feed to each element. Further, all antennas using traveling wave feed are roughly the same type and size, whereas the present invention may combine a wide range of different antennas and different devices. Although traveling wave antenna systems potentially could accommodate additional devices in the collinear array by running cables or piping through the central conductor, energy is bled off as it proceeds through the slotted structure and therefore the feed to each element is not isolated, as is the case in the present invention. The functionality is limited because it does not have full control over phase and amplitude weighting. This approach also does not allow the ability to use antennas that perform at different frequency bands or perform independently of each other.

An alternate approach that allows stacking of antenna elements is to choke the antenna feed or route the feed externally. U.S. Pat. No. 3,727,231 to Galloway et al. discloses a collinear dipole array antenna with independent feeds using a narrowband technique which connects a coaxial cable to an external transmission line, in combination with λ/4 chokes for isolation, allowing a maximum of two elements. U.S. Pat. No. 4,410,893 to Griffee discloses a collinear dual dipole antenna, also using a narrowband technique to jump the gap between two biconicals. U.S. Pat. No. 5,534,880 to Button et al. discloses multiple stacked bicone antennas with a bundle of transmission lines helically wound about the cylindrical periphery of the biconical antennas. This design uses exterior routing of cable to minimize the interference problems of passing the cables up the central column. U.S. Pat. No. 6,268,834 to Josypenko discloses multiple bicone antennas wherein the feed cable is led to a center point, then directed radially along the cone to an inductive short, through the inductive short, then directed along the surface of another cone to the center line. Again, this exterior routing of the cables minimizes the pattern perturbation. As exemplified by the foregoing, such designs do allow stacked elements and do have direct feeds to the antenna elements, but unlike the present invention, employ either a choked, centrally-fed system that permits only a relatively narrowband performance, or an externally-routed feed system for broader band operation.

U.S. Pat. No. 7,170,463 to Seavey discloses a broadband communications antenna system with center-fed, stacked dipole elements having conical shaped feed points and isolated with ferrite chokes (coiled inductors across the junction). The chokes are in close proximity to the actual feed, thus reducing the radiation efficiency of the antenna system. U.S. Patent Application Publication No. 2008/0143629 to Apostolos discloses a coaxial multi-band antenna combining a VHF, a UHF and a satellite antenna on a common radiating element, using meander line or ferrite chokes to isolate the feeds for each antenna. Unlike the narrowband choked designs of Galloway and Griffee, Seavey's and Apostolos' systems are relatively broadband, like that of Applicant's U.S. Pat. No. 7,339,542. The design of the present invention, however, obviates the need for chokes to isolate the feeds for stacked elements, thus is an improvement over all choked configurations and provides significantly greater efficiency and bandwidth.

In yet another approach, stacked, collinear and relatively broadband antenna systems are made possible by using waveguide structures to provide independent separate feeds to the antenna elements. U.S. Pat. No. 4,477,812 to Frisbee, Jr. et al. discloses a collinear array receiver system with a dipole antenna mounted atop the array. Using slot excitation, however, a system such as Frisbee, Jr.'s must be electrically large, on the order of tens of wavelengths, in order to allow space for transmission via slot. The present invention, in comparison, is on the order of one wavelength, and therefore provides the desired performance using a greatly reduced footprint. U.S. Pat. No. 6,864,853 to Judd et al. discloses stacked elements (a dipole combined with patch antenna elements) in a unitary structure that provides both directional and omnidirectional beam coverage, as well as a stack of bi-conical elements each having a frusto-conical reflector portion that together form a central passageway containing a feed system of coaxial cables. The omnidirectional array of bi-conical antennas configured end-to-end appears to use a waveguide feed structure, that, again, would be electrically large. Like the foregoing, the present invention utilizes independent separate feeds for each antenna element, but does not require the electrically large conical radiators of these waveguide-fed structures.

Finally, the prior art includes another antenna type that allows stacking of coaxial and collinear antennas. Termed "CoCo" antennas, these systems incorporate the feed system as part of the radiating structure. Examples are found in U.S. Pat. No. 6,947,006 to Diximus et al., which discloses a stacked collinear narrowband antenna that radiates on the transmission line structure, and in the 2006 paper "Generalized CoCo Antennas" by B. Notaroš, M. Djordjević and Z. Popović, which presents recent contributions to the theory and design of transmission-line antennas. This paper notes that the "CoCo antenna is inherently narrowband, and as such intended for practically single-frequency operation," and therefore has a very different functionality from the present invention. As well, the feed mechanism of CoCo antennas is distinct from that of the present invention, which as described above, has the transmission line structure isolated from the radiating structure.

Additional objects and advantages of the invention are set forth, in part, in the description which follows and, in part, will be apparent to one of ordinary skill in the art from the description and/or from the practice of the invention.

SUMMARY OF THE INVENTION

In response to the foregoing challenge, Applicant has developed an innovative broadband antenna system allowing multiple antennas or other devices to be stacked collinearly, or disposed coaxially, in a single structure, without interfering with the performance of the antenna system. As illustrated in the accompanying drawings and disclosed in the accompanying claims, the invention is a broadband antenna system comprising at least one hollow radiating element having a circumference, a radiating portion, a feed portion comprising at least two tapered feed points, and a first at least one operating structure connected to and operating the feed portion, wherein the radiating portion, the feed portion and the at least two tapered feed points may be disposed coincident with the circumference, wherein the radiating portion may further comprise at least two segmentations, and wherein the at least one hollow radiating element may manifest the radiation characteristics of a bicone, and further may have a balun, wherein the balun may be integrated with the radiating portion and the feed portion, and co-planar with the circumference. The first at least one operating structure may further comprise a feed line, a coaxial cable, a transmission line, a twin lead, a stripline, and a microstrip.

The broadband antenna system may further comprise at least one device collinear to or coaxial with the at least one hollow radiating element and a second at least one operating structure, disposed within the at least one hollow radiating element and connected to the at least one device. As embodied herein, the at least one device may be operated by the second at least one operating structure, without interfering with the performance of the at least one hollow radiating element. Further, the second at least one operating structure may comprise a feed line, a coaxial cable, a power cable, a digital cable, a fiber optic cable, a wire, piping, tubing, a mechanical actuator, a gas transfer system, a liquid transfer system, and a solid material transfer system. The at least one device may further comprise an antenna element, a GPS system, a camera, an IR sensor, a light, an audio device, a radar device, and a communications system. In this embodiment, a combination of a plurality of the at least one hollow radiating element and a plurality of the at least one device permits operation over an expanded second frequency bandwidth.

The broadband antenna system may further comprise a plurality of the at least two tapered feed points, wherein the circumferential distance between each of the plurality of the at least two tapered feed points and an adjacent feed point is less than ½ wavelength of the highest frequency of operation.

In addition, the broadband antenna system may further comprise a center pipe disposed within the circumference, wherein the first at least one operating structure is routed through the center pipe. In another embodiment, both the first at least one operating structure and the second at least one operating structure are routed through the center pipe.

In an alternate embodiment, the broadband antenna system of the present invention may further comprise at least one hollow radiating element having a radiating portion with a first circumference, a substantially cylindrical feed portion with a second circumference and comprising at least two tapered feed points, a first at least one operating structure connected to and operating the feed portion, wherein the at least two tapered feed points may be disposed substantially on the second circumference of the substantially cylindrical feed portion, wherein the radiating portion may further comprise at least two segmentations, and wherein the at least one hollow radiating element may manifest the radiation characteristics of a bicone, and further may have a balun, wherein the balun may be integrated with the radiating portion and the feed portion, and co-planar with at least one of the first circumference and the second circumference. The first at least one operating structure may further comprise a feed line, a coaxial cable, a transmission line, a twin lead, a stripline, and a microstrip.

In the alternate embodiment of the present invention, the broadband antenna system may further comprise at least one device collinear to or coaxial with the at least one hollow radiating element; a second at least one operating structure, disposed within the at least one hollow radiating element and connected to the at least one device, wherein the at least one device is operated by the second at least one operating structure, without interfering with the performance of the at least one hollow radiating element. Further, the second at least one operating structure may comprise a feed line, a coaxial cable, a power cable, a digital cable, a fiber optic cable, a wire, piping, tubing, a mechanical actuator, a gas transfer system, a liquid transfer system, and a solid material transfer system. The at least one device may further comprise an antenna element, a GPS system, a camera, an IR sensor, a light, an audio device, a radar device, and a communications system. In this alternate embodiment, a combination of a plurality of the at least one hollow radiating element and a plurality of the at least one device permits operation over an expanded second frequency bandwidth.

The broadband antenna system may further comprise a plurality of the at least two tapered feed points, wherein the circumferential distance between each of the plurality of the at least two tapered feed points and an adjacent feed point is less than ½ wavelength of the highest frequency of operation.

In addition, the broadband antenna system of this alternate embodiment may further comprise a center pipe disposed within the circumference, wherein the first at least one operating structure is routed through the center pipe. In another embodiment, both the first at least one operating structure and the second at least one operating structure are routed through the center pipe.

DETAILED DESCRIPTION OF THE INVENTION

Figure 1:
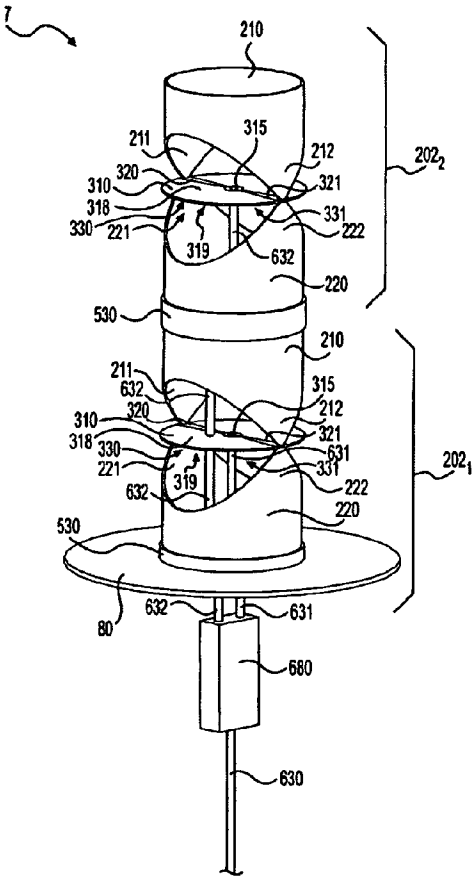
FIG. 1 is a perspective view of a stacked collinear double coneless biconical omni-directional antenna system having coneless cylindrical dual feed radiators and a power combiner, disposed on a ground plane, as disclosed in Applicant's co-pending application, U.S. patent application Ser. No. 12/408,259.

Referring to FIG. 1, stacked coneless double biconical omni-directional antenna system 7 is shown, as disclosed in Applicant's co-pending U.S. patent application Ser. No. 12/408,259, having two coneless biconical antennas stacked in a collinear array. Coneless biconical omni-directional antenna system 7 comprises first coneless biconical $\mathbf{202}_1$, disposed on substrate 80. First coneless biconical $\mathbf{202}_1$ may be separated from substrate 80 by dielectric isolator 530, as shown, or may be attached directly to substrate 80, depending on the nature of the installation. First coneless biconical $\mathbf{202}_1$ preferably comprises upper coneless radiator 210 disposed on balun 310, which further comprises upper or feed side 318 and lower or ground side 319 (not visible in the perspective view). Upper coneless radiator 210 preferably is shaped to provide first upper tapered feed point 211 and second upper tapered feed point 212, which are electrically connected respectively with first feed side trace 320 and second feed side trace 321, on feed side 318 of balun 310. Coneless biconical $\mathbf{202}_1$ further comprises lower coneless radiator 220 disposed on ground side 319 of balun 310. Not visible in the perspective view are first ground side trace 330 and second ground side trace 331. Lower coneless radiator 220 preferably is shaped to provide first lower tapered feed point 221 and second lower tapered feed point 222, which are electrically connected respectively with first ground side trace 330 and second ground side trace 331, on ground side 319 of balun 310. In this collinear stacked configuration, coneless double biconical omni-directional antenna system 7 further comprises a second coneless biconical $\mathbf{202}_2$, substantially the same as first coneless biconical $\mathbf{202}_1$ as described above, and stacked collinearly on top of first coneless biconical $\mathbf{202}_1$. Second coneless biconical $\mathbf{202}_2$ preferably is separated from first coneless biconical $\mathbf{202}_1$ by dielectric isolator 530. Stacked coneless biconical antenna system 7 is fed by coaxial cable 630, which may be routed through power divider 680, as shown, or may be fed directly into first coneless biconical $\mathbf{202}_1$. As shown herein with power divider 680, first coneless biconical $\mathbf{202}_1$ is fed by first feed line 631 (as embodied herein, a coaxial cable), that runs to central balun hole 315 of first coneless biconical $\mathbf{202}_1$. Second coneless biconical $\mathbf{202}_2$ is fed independently by second feed line 632 (as embodied herein, again a coaxial cable). Second feed line 632 preferably is run through the hollow center of first coneless biconical $\mathbf{202}_1$, through balun 310 of first coneless biconical $\mathbf{202}_1$, through hollow center of coneless radiator 220 of second coneless biconical $\mathbf{202}_2$, to central balun hole 315 of second coneless biconical $\mathbf{202}_2$. Both coneless biconicals, $\mathbf{202}_1$ and $\mathbf{202}_2$, are fed at their respective upper tapered feed points (211 and 212) and lower tapered feed points (220 and 221) by their respective feed lines (631 and 632), which connect electrically at their respective central balun holes 315, to their respective feed side traces (320 and 321), and ground side traces (330 and 331).

With continuing reference to FIG. 1, Applicant defined stacked coneless double biconical omni-directional antenna system 7 as having "dual feed radiators," in that each coneless radiator (upper coneless radiator 210 and lower coneless radiator 220) has two tapered feed points (upper tapered feed points 211 and 212 for upper coneless radiator 210, and lower tapered feed points 221 and 222 for lower coneless radiator 220), in contrast to the prior art which disclosed one feed point for each typical radiator cone. The tapered feed points, electrically connected to both feed side traces and ground side traces, allowed the conical radiator of the prior art "cone" to be opened up and formed as a "coneless" radiator on the circumference of the antenna cylinder. This enabled feed lines and cables to be routed through the hollow center of the antenna cylinder, without causing interference.

Figure 2B:
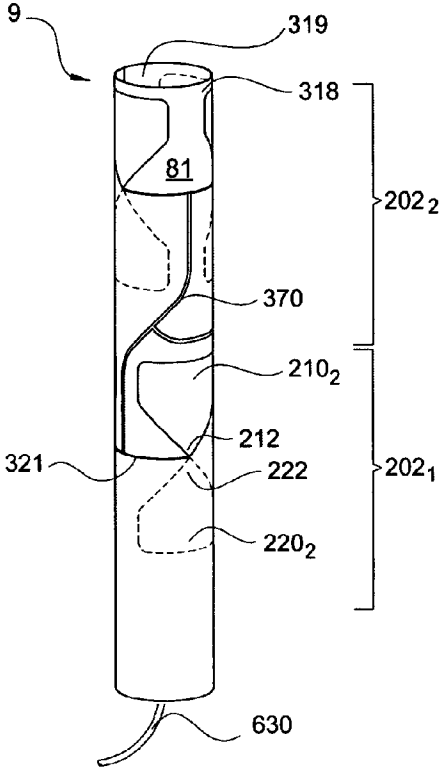
FIG. 2*b* is a perspective view of FIG. 2*a*, rotated ½ turn to show the second set of upper and lower radiator segments, according to a first embodiment of the present invention.
Figure 2A:
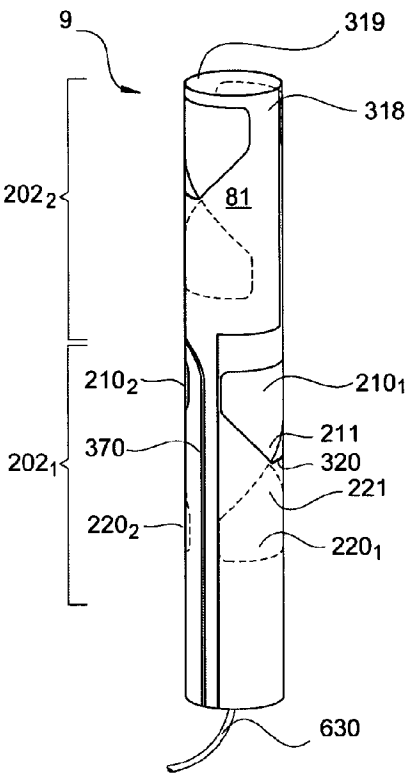
FIG. 2*a* is a perspective view of a stacked collinear double coneless biconical omni-directional antenna system having segmented coneless radiators with two feeds per bicone and an integrated, co-planar balun according to a first embodiment of the present invention.

Referring to FIG. 2*a*, stacked coneless double biconical omni-directional antenna system 9 of the present invention is an improvement over Applicant's co-pending stacked coneless biconical omni-directional antenna system 7. Stacked coneless biconical omni-directional antenna system 9 preferably comprises at least one coneless biconical $\mathbf{202}_1$, having at least one upper coneless radiator 210 and at least one lower coneless radiator 220 disposed on substrate 81, which may be rolled into a cylindrical shape. As embodied herein, upper coneless radiator 210 of coneless biconical $\mathbf{202}_1$ preferably is divided into two upper coneless radiator segments 210, (distinguished herein as $\mathbf{210}_1$ and $\mathbf{210}_2$, clockwise from front center), which are formed on substrate 81, which further comprises outside surface 318 and inside surface 319. Preferably, balun outside surface 318 is the feed side and inside surface 319 is the ground side of corporate feed network 370. Upper coneless radiator 210 preferably is shaped to provide first upper tapered feed point 211 and second upper tapered feed point 212 (not shown in perspective drawing), which are electrically connected respectively with first feed side trace 320 and second feed side trace 321 (not shown in perspective drawing), on outside or feed side 318 of substrate 81. As embodied herein, coneless biconical $\mathbf{202}_1$ further comprises lower coneless radiator 220 disposed on inside or ground side 319 of substrate 81. As embodied herein, lower coneless radiator 220 of coneless biconical $\mathbf{202}_1$ preferably is divided into two lower coneless radiator segments 220, (distinguished herein as $\mathbf{220}_1$ and $\mathbf{220}_2$, clockwise from front center), shown by dashed lines, as they are not visible on inside 319 of rolled substrate 81. Not visible in the perspective view are first ground side trace 330 and second ground side trace 331. Lower coneless radiator 220 preferably is shaped to provide first lower tapered feed point 221 and second lower tapered feed point 222 (not shown), which are electrically connected respectively with first ground side trace 330 and second ground side trace 331 on ground side 319 of substrate 81. Coneless biconical 202 preferably is fed by coaxial cable 630. First feed side trace 320 and second feed side trace 321, along with first ground side trace 330 and second ground side trace 331, and the feed lines that connect them, collectively comprise corporate feed network 370. In this collinear stacked configuration, coneless double biconical omni-directional antenna system 9 further comprises a second coneless biconical $\mathbf{202}_2$, substantially the same as first coneless biconical $\mathbf{202}_1$ as described above, and stacked collinearly on top of first coneless biconical $\mathbf{202}_1$. Upper coneless radiator 210, lower coneless radiator 220, corporate feed network 370, including feed side traces 320 and 32, and ground side traces 330, and 331, may be formed from any appropriate conductive material, preferably copper, through a photolithographic or other process onto a printed circuit board, which is then formed or "rolled" into a cylinder shape. As shown, the feed system for stacked double coneless biconical omni-directional antenna system 9 is a coaxial cable, however, the present invention contemplates that other feed systems such as transmission lines, twin lead, stripline, microstrip and other appropriate feeds, may be used, and fall within the scope of the invention.

With continuing reference to FIG. 2*a*, Applicant defines stacked double coneless biconical omni-directional antenna system 9 of the present invention as having "single feed radiators," in that each coneless radiator segment has one tapered feed point (upper tapered feed points 211 and 212 for upper coneless radiator segments $\mathbf{210}_1$, and $\mathbf{210}_2$, respectively, and lower tapered feed points 221 and 222 for lower coneless radiator portions $\mathbf{220}_1$, and $\mathbf{220}_2$, respectively) in contrast to the dual feed radiators of Applicant's prior design disclosed in co-pending U.S. patent application Ser. No. 12/408,259. Each coneless biconical 202 of the this embodiment thus has two feeds (considering the feed side trace and ground side trace for each pair of upper and lower radiator portions collectively as one feed), and thus for stacked coneless double biconical omni-directional antenna system 9, the total number of coneless radiator segments 210 is 8 and the total number of feeds is 4. As in Applicant's prior design disclosed in co-pending U.S. patent application Ser. No. 12/408,259, the tapered feed points of the coneless radiators of the present invention are electrically connected to both feed side traces and ground side traces, allowing the conical radiator of the prior art "cone" to be opened up and formed as a "coneless" radiator on the circumference of the antenna cylinder." In this embodiment of the present invention, however, each coneless radiator is divided into two segments, each with its own tapered feed point. The coneless radiators are formed on a printed circuit board, along with the feed side traces and ground side traces. The feed side traces, ground side traces and the feed lines that connect them collectively comprise a corporate feed network and form a balun that in the present invention is "rolled" around the circumference of the antenna cylinder and thus is termed "co-planar" with the cylinder. The printed circuit board may be formed into a cylinder or other closed surface, which, like Applicant's prior design disclosed in co-pending U.S. patent application Ser. No. 12/408,259, is hollow, enabling feed lines and cables to be routed through the center of the antenna, without causing interference.

Referring to FIG. 2*b*, the stacked coneless double biconical omni-directional antenna system 9 of the present invention that is shown in FIG. 2*a* is rotated ½ turn to show the second set of upper and lower radiator segments, namely upper coneless radiator segment $\mathbf{210}_2$ and second upper tapered feed point 212, of coneless biconicals $\mathbf{202}_1$, and $\mathbf{202}_2$. Second upper tapered feed point 212 is electrically connected with second feed side trace 321. As described above in connections with FIG. 2*a*, antenna system 9 preferably further comprises lower coneless radiator segment $\mathbf{220}_2$ and second lower tapered feed point 222, shown as dashed lines as they are not visible on inside 319 of rolled substrate 81. Second lower tapered feed point 222 is electrically connected with second ground side trace 331 (not shown).

Figure 3:
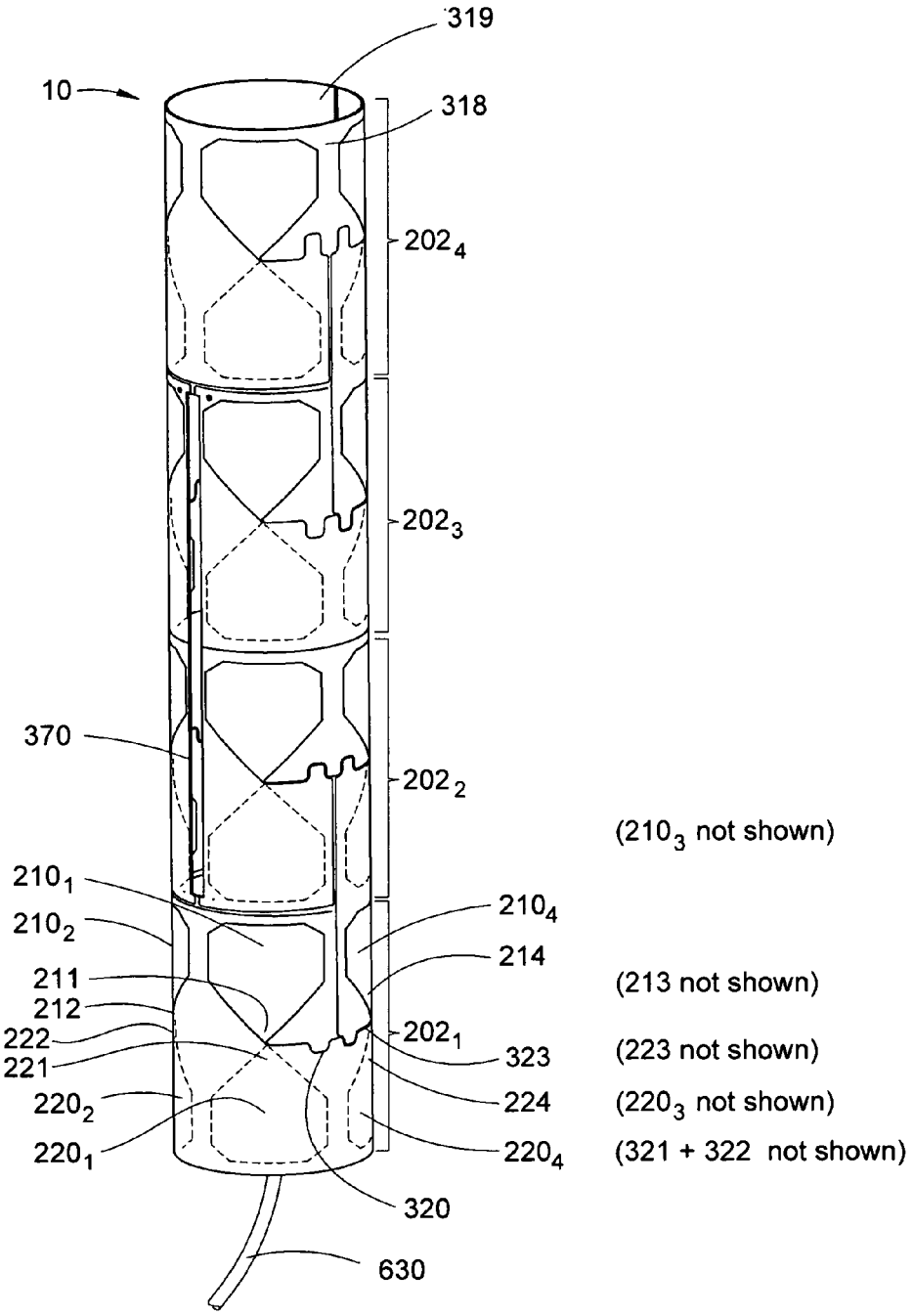
FIG. 3 is a perspective view of a stacked collinear quadruple coneless biconical omni-directional antenna system having segmented coneless radiators with four feeds per bicone and an integrated, co-planar balun according to a second embodiment of the present invention.

Referring now to FIG. 3, stacked coneless quadruple biconical omni-directional antenna system 10 of the present invention is shown. Stacked coneless quadruple biconical omni-directional antenna system 10 preferably comprises four stacked coneless biconicals 202, distinguished herein as $\mathbf{202}_1$, $\mathbf{202}_2$, $\mathbf{202}_3$ and $\mathbf{202}_4$. As embodied herein, each coneless biconical 202 further comprises upper coneless radiator 210, preferably divided into four upper coneless radiator segments $\mathbf{210}_1$, $\mathbf{210}_2$, $\mathbf{210}_3$ and $\mathbf{210}_4$, (clockwise from front center), which are formed on substrate 81, which further comprises outside surface 318 and inside surface 319. Preferably, balun outside surface 318 is the feed side and inside surface 319 is the ground side of corporate feed network 370. Upper coneless radiator segments $\mathbf{210}_1$, $\mathbf{210}_2$, $\mathbf{210}_3$ and $\mathbf{210}_4$ preferably are shaped to provide first upper tapered feed point 211, second upper tapered feed point 212, third upper tapered feed point 213 (not shown in perspective drawing) and fourth upper tapered feed point 214 respectively, which are electrically connected respectively with first feed side trace 320, second feed side trace 321 (not shown in perspective drawing), third feed side trace 322 (not shown in perspective drawing), and fourth feed side trace 323, on outside or feed side 318 of substrate 81. As embodied herein, each coneless biconical 202 further comprises lower coneless radiator 220 disposed on inside or ground side 319 of substrate 81. As embodied herein, each lower coneless radiator 220 preferably is divided into four lower coneless radiator segments $\mathbf{220}_1$, $\mathbf{220}_2$, $\mathbf{220}_3$ and $\mathbf{220}_4$, (clockwise from front center), shown by dashed lines, as they are not visible on the inside of rolled substrate 81. Not visible in the perspective view are first ground side trace 330, second ground side trace 331, third ground side trace 332, second ground side trace 331. Lower coneless radiator segments $\mathbf{220}_1$, $\mathbf{220}_2$, $\mathbf{220}_3$ and $\mathbf{220}_4$ preferably are shaped to provide first lower tapered feed point 221, second lower tapered feed point 222, third lower tapered feed point 223 (not shown), and fourth lower tapered feed point 224 respectively, which are electrically connected respectively with first ground side trace 330, second ground side trace 331, third ground side trace 332 and fourth ground side trace 333 on ground side 319 of substrate 81. Coneless biconicals $\mathbf{202}_1$, $\mathbf{202}_2$, $\mathbf{202}_3$ and $\mathbf{202}_4$ preferably are fed by coaxial cable 630. First feed side trace 320, second feed side trace 321, third feed side trace 322 and fourth feed side trace 323, along with first ground side trace 330, second ground side trace 331, third ground side trace 332 and fourth ground side trace 333, and the feed lines that connect them, collectively comprise corporate feed network 370. Upper coneless radiator 210, lower coneless radiator 220, corporate feed network 370, including feed side traces 320, 321, 322 and 323 and ground side traces 330, 331, 332 and 333, may be formed from any appropriate conductive material, preferably copper, through a photolithographic or other process onto a printed circuit board, which is then formed or "rolled" into a cylinder shape. As shown, the feed system for stacked quadruple coneless biconical omni-directional antenna system 10 is a coaxial cable, however, the present invention contemplates that other feed systems such as transmission lines, twin lead, stripline, microstrip and other appropriate feeds, may be used, and fall within the scope of the invention.

With continuing reference to FIG. 3, Applicant defines stacked quadruple coneless biconical omni-directional antenna system 10 of the present invention as having "single feed radiators," in that each coneless radiator segment has one tapered feed point (upper tapered feed points 211, 212, 213 and 214 for upper coneless radiator segments $\mathbf{210}_1$, $\mathbf{210}_2$, $\mathbf{210}_3$ and $\mathbf{210}_4$, respectively, and lower tapered feed points 221, 222, 223 and 224 for lower coneless radiator segments $\mathbf{220}_1$, $\mathbf{220}_2$, $\mathbf{220}_3$ and $\mathbf{220}_4$, respectively) in contrast to the dual feed radiators of Applicant's prior design disclosed in co-pending U.S. patent application Ser. No. 12/408,259. Each coneless biconical 202 of the present invention thus has four feeds (considering the feed side trace and ground side trace for each pair of upper and lower radiator portions collectively as one feed), and thus for stacked coneless double biconical omni-directional antenna system 10, the total number of coneless radiator segments 210 is 32 and the total number of feeds is 16. As in Applicant's prior design disclosed in co-pending U.S. patent application Ser. No. 12/408,259, the tapered feed points of the coneless radiators of the present invention are electrically connected to both feed side traces and ground side traces, allowing the conical radiator of the prior art "cone" to be opened up and formed as a "coneless" radiator on the circumference of the antenna cylinder." In the present invention, however, each coneless radiator is divided into four segments, each with its own tapered feed point. The coneless radiators are formed on a printed circuit board, along with the feed side traces and ground side traces. The feed side traces, ground side traces and the feed lines that connect them collectively comprise a corporate feed network and form a balun that in the present invention is "wrapped" around the circumference of the antenna cylinder and thus is termed "co-planar" with the cylinder. The printed circuit board is formed into a cylinder, which, like Applicant's prior design disclosed in co-pending U.S. patent application Ser. No. 12/408,259, is hollow, enabling feed lines and cables to be routed through the center of the antenna, without causing interference.

Figure 4:
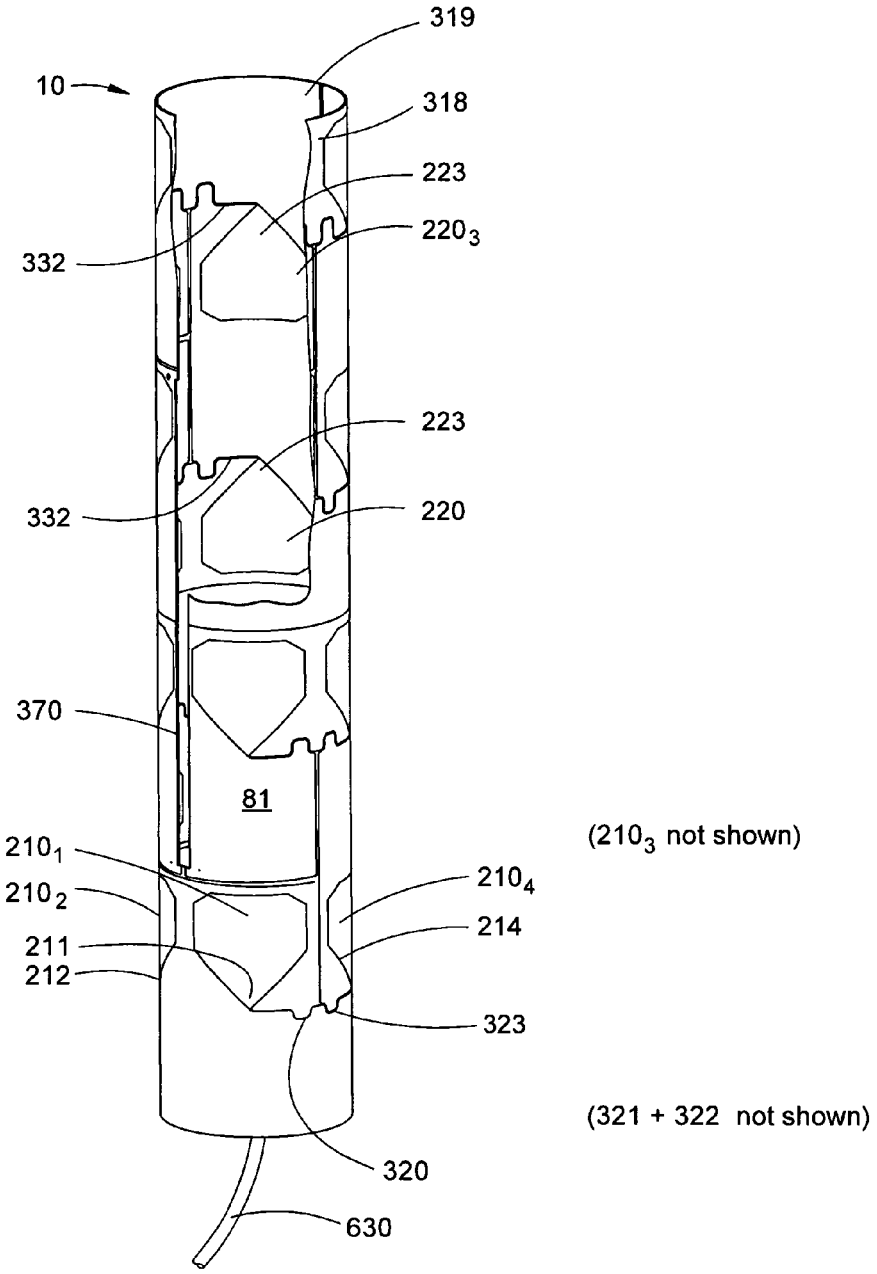
FIG. 4 is a perspective view of a stacked collinear quadruple coneless biconical omni-directional antenna system having segmented coneless radiators with four feeds per bicone and an integrated, co-planar balun, with a cutout showing the ground side radiators, according to a second embodiment of the present invention.

Referring now to FIG. 4, the stacked coneless quadruple biconical omni-directional antenna system 10 of FIG. 3 is shown with a cutout to reveal several of the lower coneless radiator portions 220 and related elements that are formed on the ground side or inside surface 319 of substrate 81. As described above in connection with FIG. 3, each coneless biconical further comprises upper coneless radiator 210, preferably divided into four upper coneless radiator segments $\mathbf{210}_1$, $\mathbf{210}_2$, $\mathbf{210}_3$ and $\mathbf{210}_4$, (clockwise from front center), which are formed on substrate 81, which further comprises outside surface 318 and inside surface 319. Preferably, balun outside surface 318 is the feed side and inside surface 319 is the ground side of corporate feed network 370. Upper coneless radiator segments $\mathbf{210}_1$, $\mathbf{210}_2$, $\mathbf{210}_3$ and $\mathbf{210}_4$ preferably are shaped to provide first upper tapered feed point 211, second upper tapered feed point 212, third upper tapered feed point 213 (not shown in perspective drawing) and fourth upper tapered feed point 214 respectively, which are electrically connected respectively with first feed side trace 320, second feed side trace 321 (not shown in perspective drawing), third feed side trace 322 (not shown in perspective drawing), and fourth feed side trace 323, on outside or feed side 318 of substrate 81. As embodied herein, each coneless biconical further comprises lower coneless radiator 220 disposed on inside or ground side 319 of substrate 81. As embodied herein, each lower coneless radiator 220 preferably is divided into four lower coneless radiator segments $\mathbf{220}_1$ (not shown), $\mathbf{220}_2$ (not shown), $\mathbf{220}_3$ and $\mathbf{220}_4$ (not shown) (clockwise from front center). Visible through the cutout is third ground side trace 332, whereas first ground side trace 330, second ground side trace 331, fourth ground side trace 333 are not visible through the cutout. Lower coneless radiator segments $\mathbf{220}_1$, $\mathbf{220}_2$, $\mathbf{220}_3$ and $\mathbf{220}_4$ preferably are shaped to provide first lower tapered feed point 221 (not shown), second lower tapered feed point 222 (not shown), third lower tapered feed point 223, and fourth lower tapered feed point 224 (not shown) respectively, which are electrically connected respectively with first ground side trace 330 (not shown), second ground side trace 331 (not shown), third ground side trace 332 and fourth ground side trace 333 (not shown) on ground side 319 of substrate 81. As described above in connection with FIG. 3, the coneless biconicals of the present invention preferably are fed by coaxial cable 630. First feed side trace 320, second feed side trace 321 (not shown), third feed side trace 322 (not shown), and fourth feed side trace 323, along with first ground side trace 330 (not shown), second ground side trace 331 (not shown), third ground side trace 332 and fourth ground side trace 333 (not shown), and the feed lines that connect them, collectively comprise corporate feed network 370.

Figure 5B:
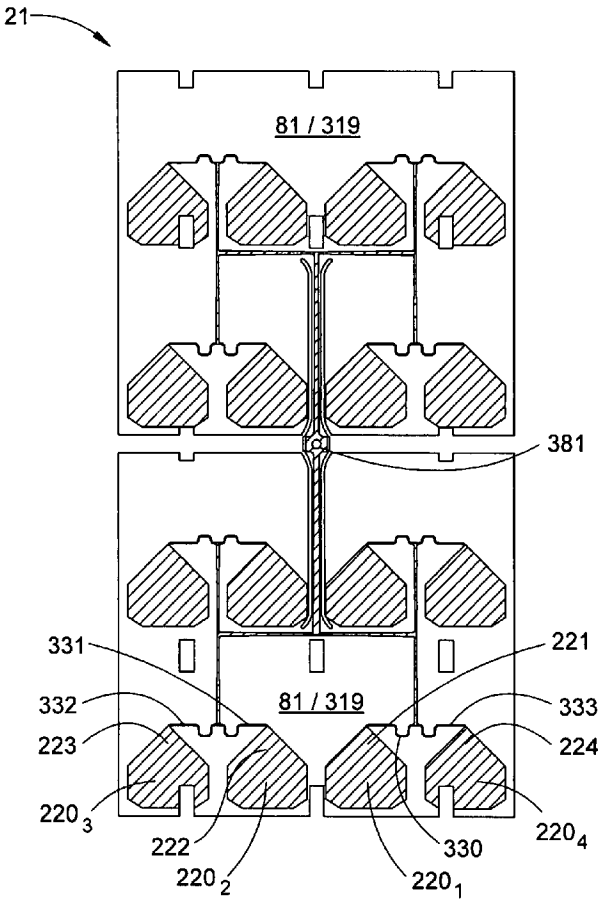
FIG. 5*b* is a bottom view of a printed circuit board showing the ground side of a quadruple coneless biconical omni-directional antenna system having segmented coneless radiators and an integrated, co-planar balun, according to a second embodiment of the present invention.
Figure 5A:
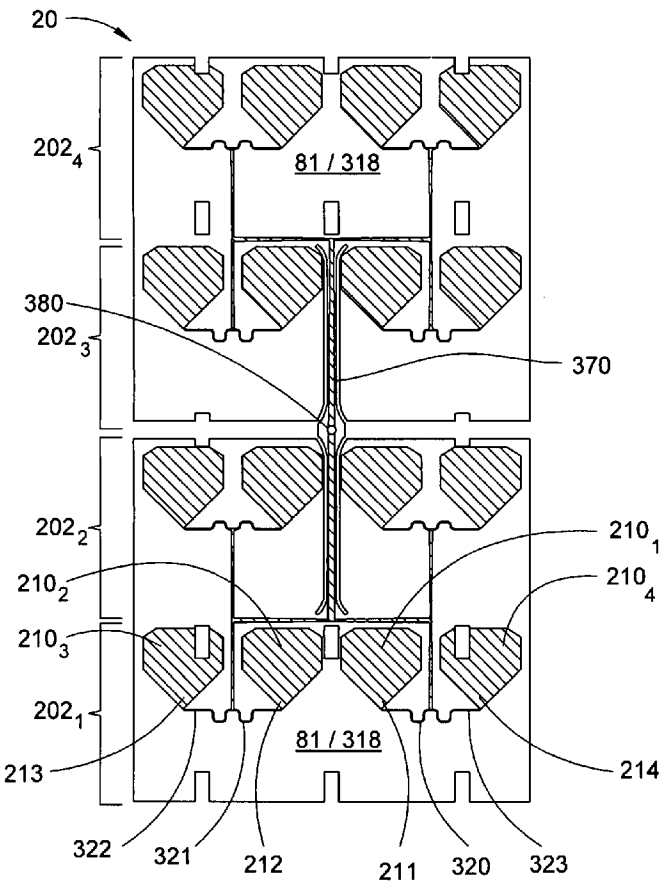
FIG. 5*a* is a top view of a printed circuit board showing the feed side of a stacked quadruple coneless biconical omni-directional antenna system having segmented coneless radiators and an integrated, co-planar balun, according to a second embodiment of the present invention.

Referring now to FIG. 5*a*, printed circuit board 20 is shown in a top view, flat before it is rolled to form the antenna cylinder. Printed circuit board 20 is preferably the top or feed side or outside 318 of substrate 81, and as embodied herein comprises four coneless biconicals 202, distinguished herein as $\mathbf{202}_1$, $\mathbf{202}_2$, $\mathbf{202}_3$ and $\mathbf{202}_4$. As embodied herein, each coneless biconical 202 further comprises upper coneless radiator 210, preferably divided into four upper coneless radiator segments $\mathbf{210}_1$, $\mathbf{210}_2$, $\mathbf{210}_3$ and $\mathbf{210}_4$, (right to left from $210_4$), which are formed on top or outside surface 318 of substrate 81. Preferably, balun top or outside surface 318 is the feed side of corporate feed network 370. Upper coneless radiator segments $\mathbf{210}_1$, $\mathbf{210}_2$, $\mathbf{210}_3$ and $\mathbf{210}_4$ preferably are shaped to provide first upper tapered feed point 211, second upper tapered feed point 212, third upper tapered feed point 213 and fourth upper tapered feed point 214 respectively, which are electrically connected respectively with first feed side trace 320, second feed side trace 321, third feed side trace 322 and fourth feed side trace 323, on top or outside or feed side 318 of substrate 81. Substrate 81 further comprises feed side feed point 380, which connects to the center conductor of coaxial cable 630 (not shown).

Referring now to FIG. 5*b*, printed circuit board 21 is shown in a top view, flat before it is rolled to form the antenna cylinder. Printed circuit board 21 is preferably the bottom or ground side or inside 319 of substrate 81, and as embodied herein comprises the ground side portions of the four coneless biconicals 202, distinguished herein as $\mathbf{202}_1$, $\mathbf{202}_2$, $\mathbf{202}_3$ and $\mathbf{202}_4$, as described and shown above in connection with FIG. 5*a*. As embodied herein, each coneless biconical 202 further comprises lower coneless radiator 220, preferably divided into four lower coneless radiator segments $\mathbf{220}_1$, $\mathbf{220}_2$, $\mathbf{220}_3$ and $\mathbf{220}_4$ (right to left from $220_4$), which are formed on bottom or inside surface 319 of substrate 81. Preferably, balun bottom or inside surface 319 is the ground side of corporate feed network 370. Lower coneless radiator segments $\mathbf{220}_1$, $\mathbf{220}_2$, $\mathbf{220}_3$ and $\mathbf{220}_4$ preferably are shaped to provide first lower tapered feed point 221, second lower tapered feed point 222, third lower tapered feed point 223 and fourth lower tapered feed point 224 respectively, which are electrically connected respectively with first ground side trace 330, second ground side trace 331, third ground side trace 332 and fourth ground side trace 333, on bottom or inside or ground side 319 of substrate 81. Substrate 81 further comprises ground side feed point 381, which connects to the ground conductor of coaxial cable 630 (not shown).

With continuing reference to FIGS. 5*a* and 5*b*, upper coneless radiator segments $\mathbf{210}_1$, $\mathbf{210}_2$, $\mathbf{210}_3$ and $\mathbf{210}_4$, including feed side traces 320, 321, 322 and 323, may be formed onto top or feed side or outside 318 of printed circuit board 20, and lower coneless radiator portions $\mathbf{220}_1$, $\mathbf{220}_2$, $\mathbf{220}_3$ and $\mathbf{220}_4$, and ground side traces 330, 331, 332 and 333, may be formed onto printed circuit board 21, from any appropriate conductive material, preferably copper, through a photolithographic or other process, supported on substrate 81, which is then formed or "rolled" into a cylinder shape to form a coneless quadruple biconical antenna system 10 of the present invention.

Figure 6:
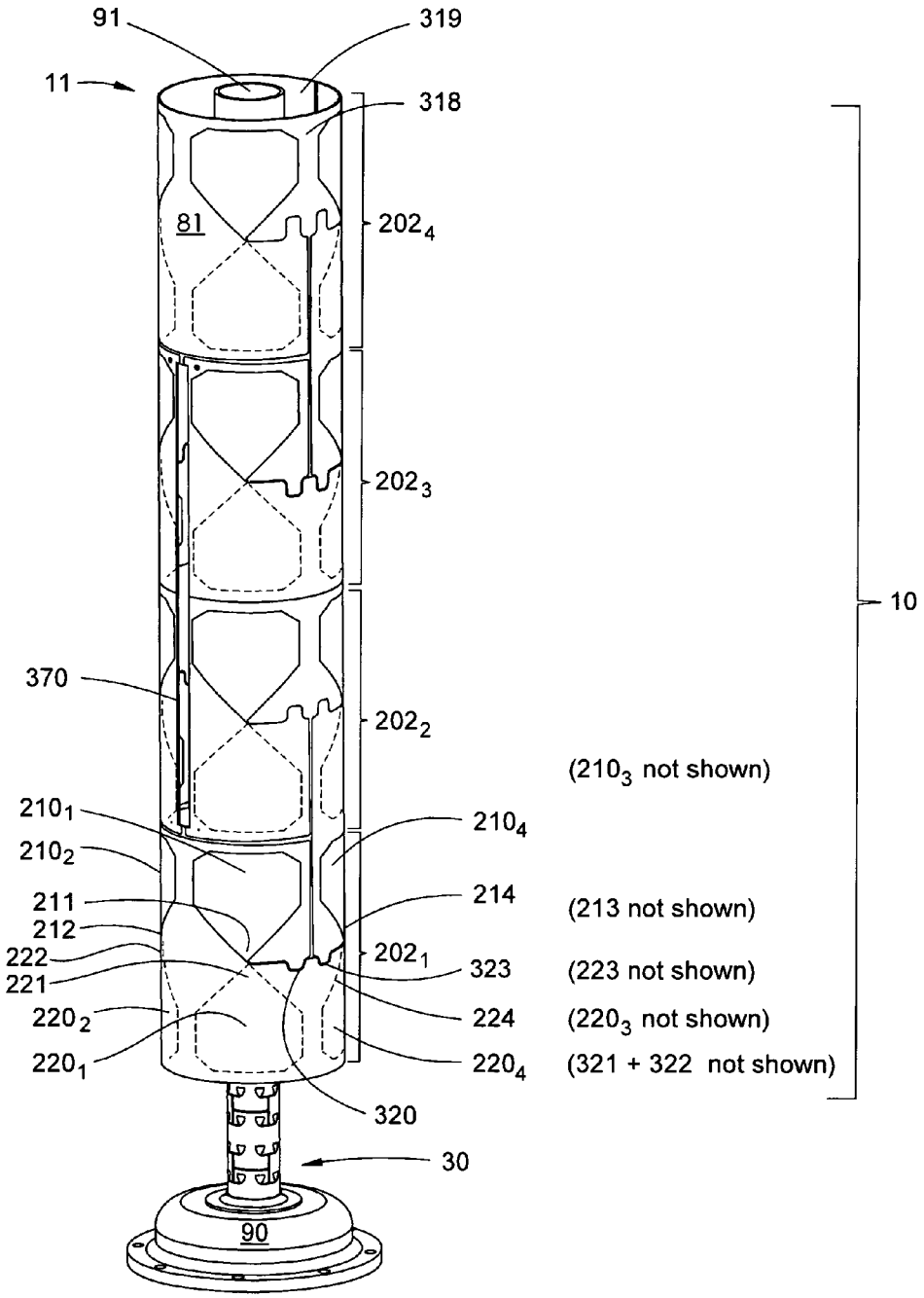
FIG. 6 is a perspective view of a KU band dipole array having a cylindrical ground plane (known in the prior art), stacked with a collinear quadruple coneless biconical omni-directional antenna system having segmented coneless radiators with four feeds per bicone and an integrated, co-planar balun, according to a third embodiment of the present invention.

Referring now to FIG. 6, stacked multi-octave multi-band high-gain omni-directional antenna system 11 of the present invention is shown. Stacked multi-octave multi-band high-gain omni-directional antenna system 11 comprises a KU band dipole array 30 having a cylindrical ground plane (known in the prior art), stacked with a collinear quadruple modified biconical omni-directional antenna system 10 as described above in connection with FIGS. 3, 4 and 5. KU band dipole array 30 is disposed on base 90, and coneless quadruple biconical omni-directional antenna system 10 preferably is stacked above KU band dipole array 30, to provide operation in L/S/C bands. Stacked collinear quadruple modified biconical omni-directional antenna system 10 preferably comprises four stacked coneless biconicals 202, distinguished herein as $\mathbf{202}_1$, $\mathbf{202}_2$, $\mathbf{202}_3$ and $\mathbf{202}_4$. As embodied herein, each coneless biconical 202 further comprises upper coneless radiator 210, preferably divided into four upper coneless radiator segments $\mathbf{210}_1$, $\mathbf{210}_2$, $\mathbf{210}_3$ and $\mathbf{210}_4$, (clockwise from front center), which are formed on substrate 81, which further comprises outside surface 318 and inside surface 319. Preferably, balun outside surface 318 is the feed side and inside surface 319 is the ground side of corporate feed network 370. Upper coneless radiator segments $\mathbf{210}_1$, $\mathbf{210}_2$, $\mathbf{210}_3$ and $\mathbf{210}_4$ preferably are shaped to provide first upper tapered feed point 211, second upper tapered feed point 212, third upper tapered feed point 213 (not shown in perspective drawing) and fourth upper tapered feed point 214 respectively, which are electrically connected respectively with first feed side trace 320, second feed side trace 321 (not shown in perspective drawing), third feed side trace 322 (not shown in perspective drawing), and fourth feed side trace 323, on outside or feed side 318 of substrate 81. As embodied herein, each coneless biconical 202 further comprises lower coneless radiator 220 disposed on inside or ground side 319 of substrate 81. As embodied herein, each lower coneless radiator 220 preferably is divided into four lower coneless radiator segments $\mathbf{220}_1$, $\mathbf{220}_2$, $\mathbf{220}_3$ and $\mathbf{220}_4$, (clockwise from front center), shown by dashed lines, as they are not visible on the inside of rolled substrate 81. Not visible in the perspective view are first ground side trace 330, second ground side trace 331, third ground side trace 332, second ground side trace 331. Lower coneless radiator segments $\mathbf{220}_1$, $\mathbf{220}_2$, $\mathbf{220}_3$ and $\mathbf{220}_4$ preferably are shaped to provide first lower tapered feed point 221, second lower tapered feed point 222, third lower tapered feed point 223 (not shown), and fourth lower tapered feed point 224 respectively, which are electrically connected respectively with first ground side trace 330, second ground side trace 331, third ground side trace 332 and fourth ground side trace 333 on ground side 319 of substrate 81. Coneless biconicals $\mathbf{202}_1$, $\mathbf{202}_2$, $\mathbf{202}_3$ and $\mathbf{202}_4$ preferably are fed by coaxial cable 630 (not shown). Coaxial cable 630 may be routed through center pipe 91, which may extend the length of the four stacked collinear coneless biconicals $\mathbf{202}_1$, $\mathbf{202}_2$, $\mathbf{202}_3$ and $\mathbf{202}_4$. As embodied herein, center pipe 91 keeps coaxial cable 630 properly centrally-oriented for improved performance, and also provides vertical support and rigidity for antenna system 10. First feed side trace 320, second feed side trace 321, third feed side trace 322 and fourth feed side trace 323, along with first ground side trace 330, second ground side trace 331, third ground side trace 332 and fourth ground side trace 333, and the feed lines that connect them, collectively comprise corporate feed network 370. Upper coneless radiator 210, lower coneless radiator 220, corporate feed network 370, including feed side traces 320, 321, 322 and 323 and ground side traces 330, 331, 332 and 333, may be formed from any appropriate conductive material, preferably copper, through a photolithographic or other process onto a printed circuit board, which is then formed or "rolled" into a cylinder shape. Center pipe 91 may be made from any appropriate conductive metal, such as aluminum. The preferable feed system for stacked quadruple coneless biconical antenna system 10 is a coaxial cable, however, the present invention contemplates that other feed systems such as transmission lines, twin lead, stripline, microstrip and other appropriate feeds, may be used, and fall within the scope of the invention.

Figure 7:
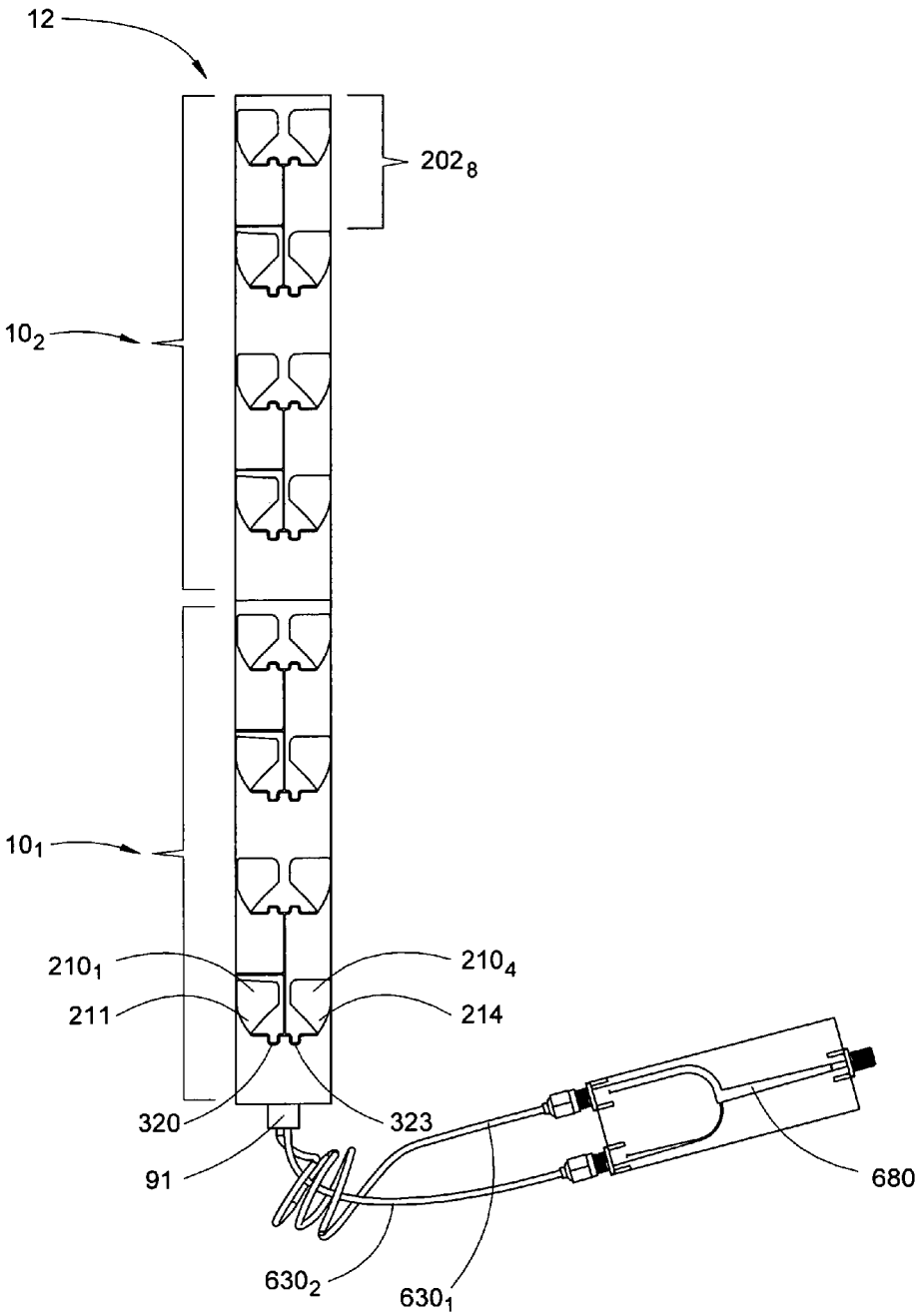
FIG. 7 is a perspective view of a stacked collinear octuple coneless biconical omni-directional antenna system having segmented coneless radiators with four feeds per bicone and an integrated, co-planar balun fed by coaxial cables through a power divider, according to a fourth embodiment of the present invention.

Referring now to FIG. 7, a fourth embodiment of the present invention is shown as stacked collinear octuple coneless biconical omni-directional antenna system 12, which preferably comprises eight stacked coneless biconicals 202 ($\mathbf{202}_1$-$\mathbf{202}_8$, however only $\mathbf{202}_8$ is labeled). Antenna system 12, as embodied herein, may alternatively be described as a collinear stack of two coneless quadruple biconical omni-directional antenna systems 10: lower stack $\mathbf{10}_1$ and upper stack $\mathbf{10}_2$. As described above in connection with FIGS. 2, 3, 4, 5 and 6, each coneless biconical 202 further comprises upper coneless radiator 210, preferably divided into four upper coneless radiator segments $\mathbf{210}_1$, $\mathbf{210}_2$, $\mathbf{210}_3$ and $\mathbf{210}_4$, (clockwise from front center, however only $\mathbf{210}_1$ is labeled), which preferably are shaped to provide first upper tapered feed point 211, second upper tapered feed point 212 (not shown), third upper tapered feed point 213 (not shown) and fourth upper tapered feed point 214 (not shown) respectively, which are electrically connected respectively with first feed side trace 320, second feed side trace 321 (not shown), third feed side trace 322 (not shown), and fourth feed side trace 323 (not shown). As embodied herein, stacked collinear octuple coneless biconical antenna system 12, further comprises power divider 680, which feeds the co-planar balun described above in connection with FIGS. 2, 3, 4, 5 and 6. Power divider 680 preferably is connected to coaxial cable $630_1$ (feeding lower stack $10_1$) and coaxial cable $630_2$ (feeding upper stack $10_2$). Coaxial cables $630_1$ and $630_2$ may be routed through center pipe 91, which may extend the length of the eight stacked collinear coneless biconicals $202_1$, $202_2$, $202_3$, $202_4$, $202_5$, $202_6$, $202_7$, and $202_8$. As embodied herein, center pipe 91 keeps coaxial cable $630_1$ and $630_2$ properly centrally-oriented for improved performance, and also provides vertical support and rigidity for antenna system 12. Center pipe 91 may be made from any appropriate conductive metal, such as aluminum. Stacked collinear octuple coneless biconical omni-directional antenna system 12 may be formed from any appropriate conductive material, preferably copper, through a photolithographic or other process onto a printed circuit board, as described above for the embodiments of FIGS. 2, 3, 4, 5 and 6.

Figure 8A:
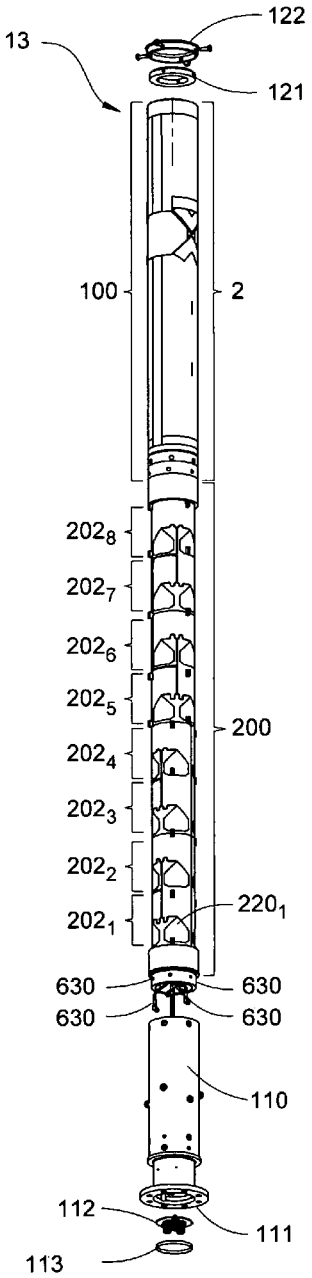
FIG. 8*a* is an isometric view of a stacked collinear octuple coneless biconical omni-directional antenna system having segmented coneless radiators with four feeds per bicone and an integrated, co-planar balun, stacked with a collinear coneless biconical antenna having coneless cylindrical dual feed radiators, according to a fifth embodiment of the present invention.

Referring now to FIG. 8*a*, a fifth embodiment of the present invention is shown as fixed site omni-directional antenna system 13, which comprises coneless sub-assembly 200 with coneless biconical omni-directional antenna 2 stacked thereon. Coneless sub-assembly 200 is preferably a stacked collinear octuple coneless biconical omni-directional antenna system having coneless radiators with four feeds per bicone and an integrated, co-planar balun, as described above in connection with FIG. 7. Coneless biconical omni-directional antenna 2 is preferably a collinear coneless biconical omni-directional antenna having coneless cylindrical dual feed radiators, as disclosed in Applicant's co-pending U.S. patent application Ser. No. 12/408,259. The present invention contemplates that alternate embodiments of antenna system 13 may substitute stacked generic device 100 for coneless biconical omni-directional antenna 2, wherein device 100 may be another antenna element, such as a SATCOM or GPS antenna; a camera, IR sensor, light, audio device such as a siren; an electrical or mechanical device operated by a hydraulic, pneumatic or mechanical control, or by a gas, liquid or solid material transfer system; or other device as desired. The present invention also contemplates that device 100 may be a combination of multiple devices as described herein. Coneless sub-assembly 200 is disposed on base tube 110, which is connected to spring base 111. Spring base 111 further comprises cable cover/feedthrough 112 which is held in place by ring 113. At the top of fixed site omni-directional antenna system 13, coneless biconical omni-directional antenna 2 is held in place by support ring 121 and top cap 122.

With continuing reference to FIG. 8*a*, coneless sub-assembly 200 further comprises eight stacked coneless biconicals 202 ($202_1$, $202_2$, $202_3$, $202_4$, $202_5$, $202_6$, $202_7$ and $202_8$). In an alternate embodiment to those described in FIGS. 2, 3, 4, 5, 6 and 7 above, the feed side coneless radiators and ground side coneless radiators are switched. Thus, each coneless biconical 202 further comprises upper coneless radiator 210, preferably divided into four upper coneless radiator portions $210_1$, $210_2$, $210_3$ and $210_4$, (not shown) disposed on the inside or ground side of the balun board, and lower coneless radiator 220, preferably divided into four lower coneless radiator segments $220_1$, $220_2$, $220_3$ and $220_4$, (clockwise from front center, however only lower coneless radiator segment $220_1$ is labeled), disposed on the outside or feed side of the balun board. Upper coneless radiator segments $210_1$, $210_2$, $210_3$ and $210_4$ (not shown) preferably are shaped to provide first upper tapered feed point 211, second upper tapered feed point 212, third upper tapered feed point 213 and fourth upper tapered feed point 214 (none of which is shown) respectively, which are electrically connected respectively with first ground side trace 330, second ground side trace 331, third ground side trace 332, and fourth ground side trace 333, (none of which is shown), on the inside or ground side of the balun board. As embodied herein, lower coneless radiator segments $220_1$, $220_2$ (not shown), $220_3$ (not shown) and $220_4$ (not shown), preferably are shaped to provide first lower tapered feed point 221, second lower tapered feed point 222, third lower tapered feed point 223, and fourth lower tapered feed point 224 (none of which is shown) respectively, which are electrically connected respectively with first feed side trace 320, second feed side trace 321, third feed side trace 322 and feed ground side trace 323 on the feed side or outside of the balun board. Coneless biconicals $202_1$, $202_2$, $202_3$, $202_4$, $202_5$, $202_6$, $202_7$ and $202_8$ preferably are fed by multiple coaxial cables 630. Coaxial cables 630 may be routed through center pipe 91 (not shown), which may extend the length of the eight stacked collinear coneless biconicals $202_1$, $202_2$, $202_3$, $202_4$, $202_5$, $202_6$, $202_7$, and $202_8$. As embodied herein, center pipe 91 keeps coaxial cables 630 properly centrally-oriented for improved performance, and also provides vertical support and rigidity for antenna system 13. Center pipe 91 may be made from any appropriate conductive metal, such as aluminum. First feed side trace 320, second feed side trace 321, third feed side trace 322 and fourth feed side trace 323, along with first ground side trace 330, second ground side trace 331, third ground side trace 332 and fourth ground side trace 333, and the feed lines that connect them, collectively comprise the corporate feed network (not labeled) of the co-planar balun of the present invention. The coneless radiators, balun, and feed and ground side traces may be formed from any appropriate conductive material, preferably copper, through a photolithographic or other process onto a printed circuit board, which is then formed or "rolled" into a cylinder shape, as described above. The feed system for antenna system 13 is coaxial cables, however, the present invention contemplates that other feed systems such as transmission lines, twin lead, stripline, microstrip and other appropriate feeds, may be used, and fall within the scope of the invention.

Figure 8B:
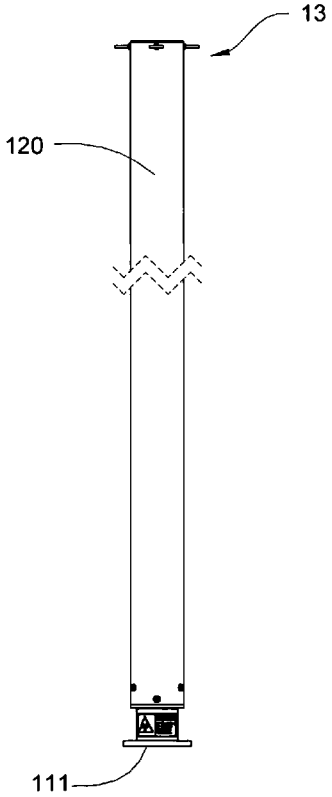
FIG. 8*b* is an isometric view of a stacked collinear octuple coneless biconical omni-directional antenna system having segmented coneless radiators with four feeds per bicone and an integrated, co-planar balun, stacked with a collinear coneless biconical antenna having coneless cylindrical dual feed radiators, enclosed in a radome, according to a fifth embodiment of the present invention.

Referring now to FIG. 8*b*, fixed site omni-directional antenna system 13, is shown supported on spring base 111 and enclosed in radome 120.

Referring now to FIGS. 9-11, elevation and azimuth radiation patterns are shown that support Applicant's assertion that the innovative integrated, co-planar balun coneless design with segmented radiators of the present invention provides comparable or even superior performance to the coneless antenna design disclosed in Applicant's co-pending U.S. patent application Ser. No. 12/408,259. The two antenna systems tested were otherwise of a similar height, diameter, number of bicones stacked (2) and number of feed points (2 per bicone).

Figure 9A:
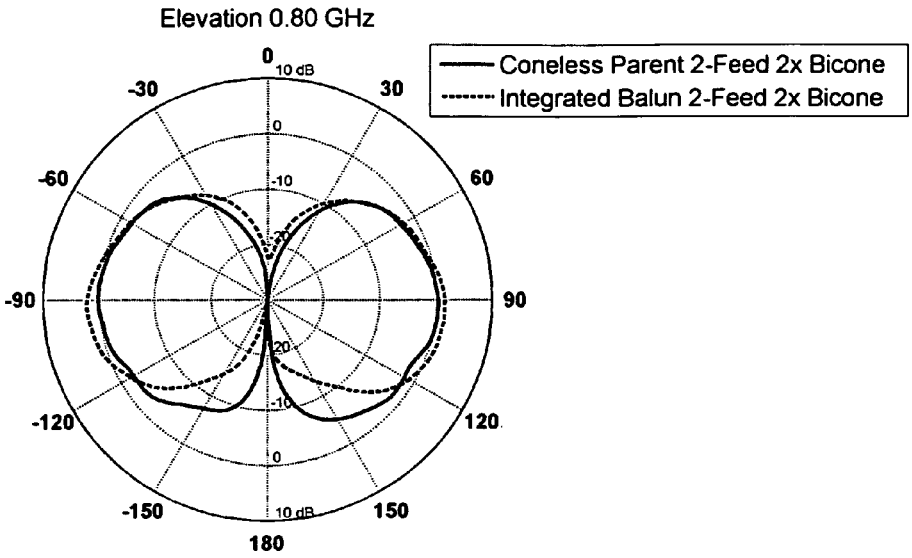
FIG. 9*a* depicts a graph, at 0.8 GHz, comparing the elevation radiation patterns of a stacked collinear double coneless biconical omni-directional antenna system having coneless cylindrical dual feed radiators as disclosed in Applicant's co-pending U.S. patent application Ser. No. 12/408,259, with a stacked collinear double coneless biconical antenna system having segmented coneless radiators with two feeds per bicone and an integrated, co-planar balun according to a first embodiment of the present invention.

Referring now to FIG. 9*a*, a graph depicts the elevation radiation patterns at 0.8 GHz, of, respectively, stacked coneless double biconical omni-directional antenna system 7, having coneless cylindrical dual feed radiators as disclosed in Applicant's co-pending U.S. patent application Ser. No. 12/408,259, and stacked coneless double biconical omni-directional antenna system 9, having coneless radiators with two feeds per bicone and an integrated, co-planar balun according to a first embodiment of the present invention, showing that the pattern shape and gain are nearly identical.

Figure 9B:
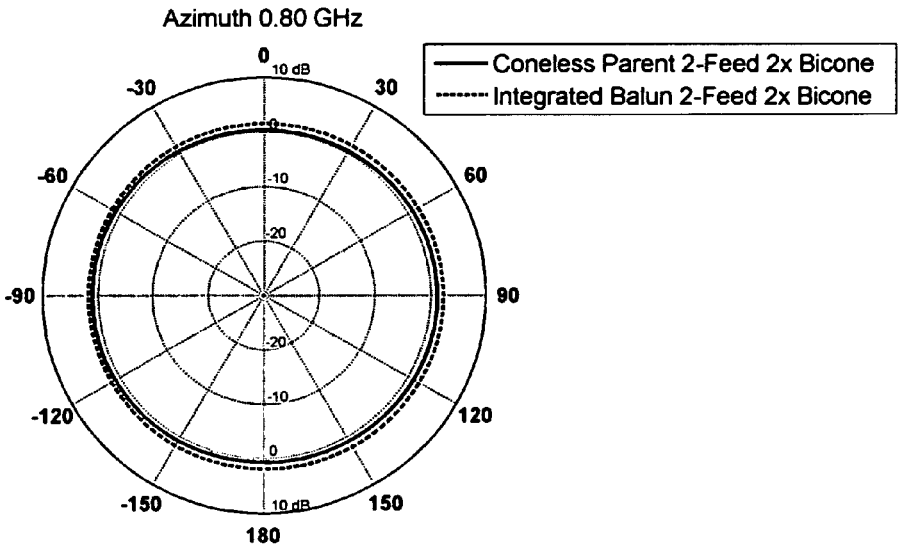
FIG. 9*b* depicts a graph, at 0.8 GHz, comparing the azimuth radiation patterns of a stacked collinear double coneless biconical omni-directional antenna system having coneless cylindrical dual feed radiators as disclosed in Applicant's co-pending U.S. patent application Ser. No. 12/408,259, with a stacked collinear double coneless biconical antenna system having segmented coneless radiators with two feeds per bicone and an integrated, co-planar balun according to a first embodiment of the present invention.

Referring now to FIG. 9*b*, a graph depicts the azimuth radiation patterns at 0.8 GHz, of, respectively, stacked coneless double biconical omni-directional antenna system 7, having coneless cylindrical dual feed radiators as disclosed in Applicant's co-pending U.S. patent application Ser. No. 12/408,259, and stacked coneless double biconical omni-directional antenna system 9, having coneless radiators with two feeds per bicone and an integrated, co-planar balun according to a first embodiment of the present invention, showing that the pattern shape and gain are nearly identical.

Figure 10A:
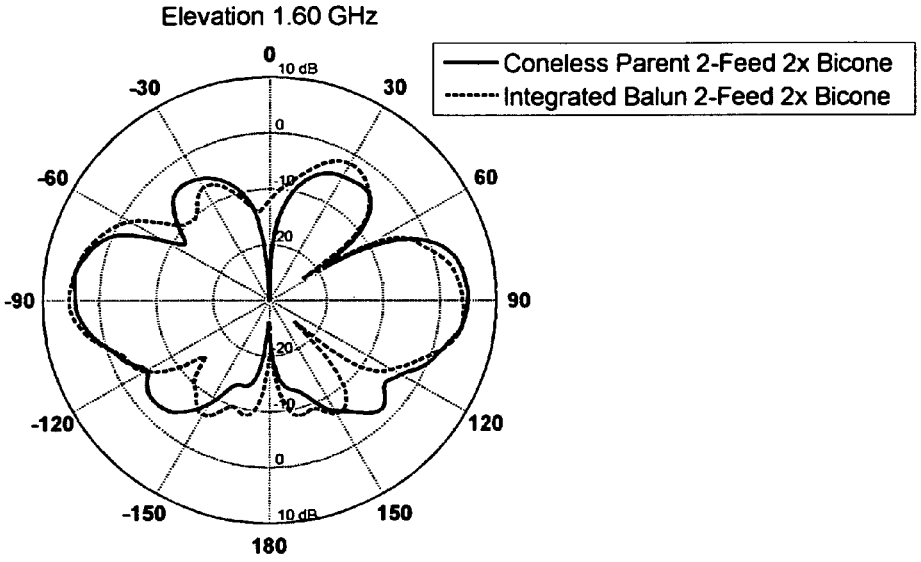
FIG. 10*a* depicts a graph, at 1.6 GHz, comparing the elevation radiation patterns of a stacked collinear double coneless biconical omni-directional antenna system having coneless cylindrical dual feed radiators as disclosed in Applicant's co-pending U.S. patent application Ser. No. 12/408,259, with a stacked collinear double coneless biconical antenna system having segmented coneless radiators with two feeds per bicone and an integrated, co-planar balun according to a first embodiment of the present invention.

Referring now to FIG. 10*a*, a graph depicts the elevation radiation patterns at 1.6 GHz, of, respectively, stacked coneless double biconical omni-directional antenna system 7, having coneless cylindrical dual feed radiators as disclosed in Applicant's co-pending U.S. patent application Ser. No. 12/408,259, and stacked coneless double biconical omni-directional antenna system 9, having coneless radiators with two feeds per bicone and an integrated, co-planar balun according to a first embodiment of the present invention, showing that the pattern shape and gain are nearly identical.

Figure 10B:
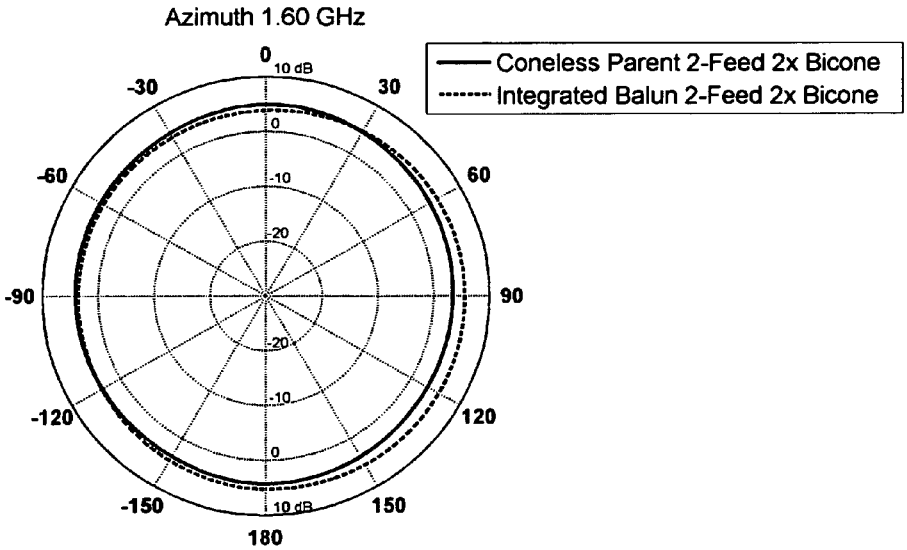
FIG. 10*b* depicts a graph, at 1.6 GHz, comparing the azimuth radiation patterns of a stacked collinear double coneless biconical omni-directional antenna system having coneless cylindrical dual feed radiators as disclosed in Applicant's co-pending U.S. patent application Ser. No. 12/408,259, with a stacked collinear double coneless biconical antenna system having segmented coneless radiators with two feeds per bicone and an integrated, co-planar balun according to a first embodiment of the present invention.

Referring now to FIG. 10*b*, a graph depicts the azimuth radiation patterns at 1.6 GHz, of, respectively, stacked coneless double biconical omni-directional antenna system 7, having coneless cylindrical dual feed radiators as disclosed in Applicant's co-pending U.S. patent application Ser. No. 12/408,259, and stacked coneless double biconical omni-directional antenna system 9, having coneless radiators with two feeds per bicone and an integrated, co-planar balun according to a first embodiment of the present invention, showing that the pattern shape and gain are nearly identical.

Figure 11A:
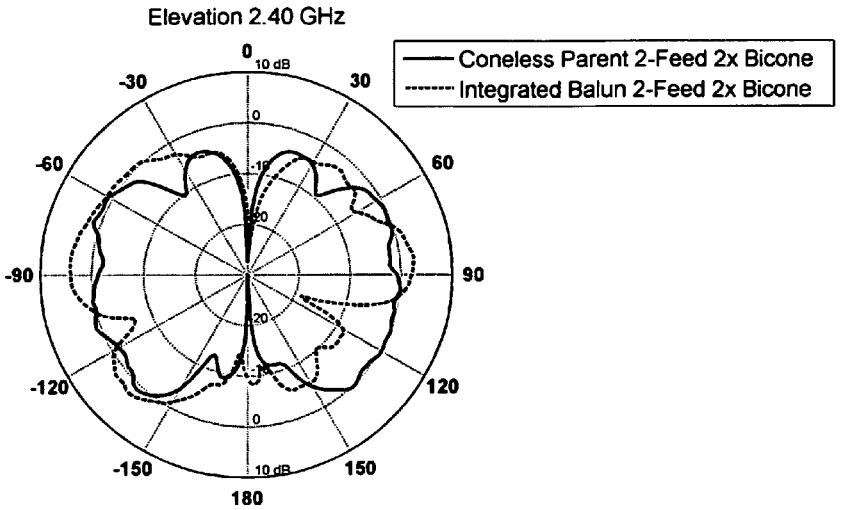
FIG. 11*a* depicts a graph, at 2.4 GHz, comparing the elevation radiation patterns of a stacked collinear double coneless biconical omni-directional antenna system having coneless cylindrical dual feed radiators as disclosed in Applicant's co-pending U.S. patent application Ser. No. 12/408,259, with a stacked collinear double coneless biconical antenna system having segmented coneless radiators with two feeds per bicone and an integrated, co-planar balun according to a first embodiment of the present invention.

Referring now to FIG. 11*a*, a graph depicts the elevation radiation patterns at 2.4 GHz, of, respectively, stacked coneless double biconical omni-directional antenna system 7, having coneless cylindrical dual feed radiators as disclosed in Applicant's co-pending U.S. patent application Ser. No. 12/408,259, and stacked coneless double biconical omni-directional antenna system 9, having coneless radiators with two feeds per bicone and an integrated, co-planar balun according to a first embodiment of the present invention, showing that the pattern shape and gain are nearly identical.

Figure 11B:
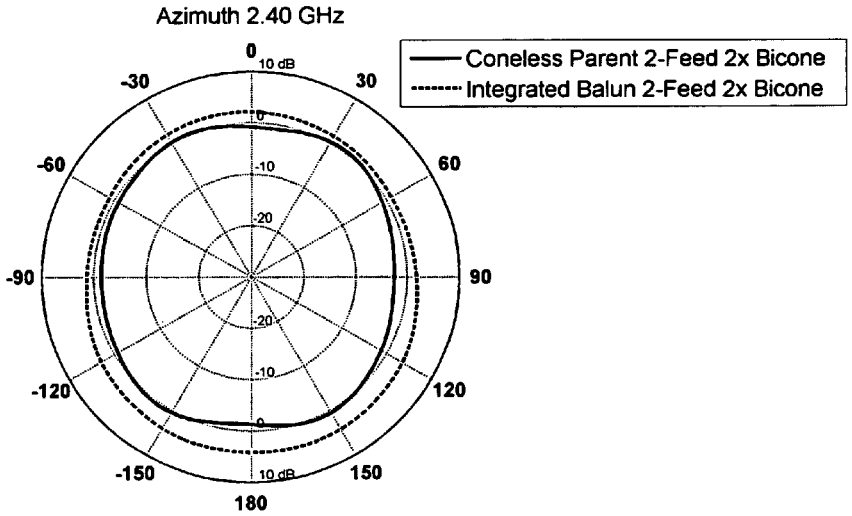
FIG. 11*b* depicts a graph, at 2.4 GHz, comparing the azimuth radiation patterns of a stacked collinear double coneless biconical omni-directional antenna system having coneless cylindrical dual feed radiators as disclosed in Applicant's co-pending U.S. patent application Ser. No. 12/408,259, with a stacked collinear double coneless biconical antenna system having segmented coneless radiators with two feeds per bicone and an integrated, co-planar balun according to a first embodiment of the present invention.

Referring now to FIG. 11*b*, a graph depicts the azimuth radiation patterns at 2.4 GHz, of, respectively, stacked coneless double biconical omni-directional antenna system 7, having coneless cylindrical dual feed radiators as disclosed in Applicant's co-pending U.S. patent application Ser. No. 12/408,259, and stacked coneless double biconical omni-directional antenna system 9, having coneless radiators with two feeds per bicone and an integrated, co-planar balun according to a first embodiment of the present invention, showing that the pattern shape and gain at a higher frequency are superior to that of antenna system 7.

It will be apparent to those skilled in that art that various modifications and variations can be made in the fabrication and configuration of the present invention without departing from the scope and spirit of the invention. For example, although corporate feed network 370 is shown with balun outside surface 318 as the feed side and inside surface 319 as the ground side, it is contemplated that balun outside surface 318 alternatively may be the ground side and inside surface 319 may be the feed side. Further, the design of the present invention contemplates multiple tapered feed points for the coneless radiator. While a preferred embodiment discloses four tapered feed points for each half of the coneless bicone, six, seven or eight or more feed points are all considered within the scope of the invention. Because the highest frequency of operation is determined by the diameter of the coneless cylinder and the number of feed points, the diameter and number may be adjusted as desired for preferred frequencies.

As another variation, two or three or more of the coneless biconical elements of the present invention may be stacked together, along with a high-gain omni-directional antenna at a given frequency band on top, and additional elements may be placed above and below the coneless biconical elements to cover additional frequency bands.

As another variation, the coneless biconical element of the present invention may be utilized in multiple frequency bands.

In addition, a variety of materials may be used to fabricate the components of the invention. For example, stealth materials, such as carbon-based compounds, may be used in order to reduce detection. The conductor surfaces may be replaced with frequency-selective surfaces whereby the surfaces act as conductors in selected frequency bands and also act as RF reactance (non-perfect conductors) at other bands.

As embodied herein, the antenna system of the present invention may be provided with any type of RF transceivers or transponders, such as radios, GPS receivers or radars; other antenna systems such as SATCOM; cameras, IR sensors, lights, and audio equipment; digital devices; as well as other electrical or mechanical devices operated by hydraulic, pneumatic or mechanical controls or actuators, or operated by a gas, liquid or solid material transfer system. Thus, the antenna system of the present invention may be used for a wide variety of applications in RF transmission and reception, navigation, communication, direction finding, radar, and electronic warfare. Thus, it is intended that the present invention cover the modifications and variations of the invention provided they come within the scope of the appended claim and their equivalents.

What is claimed is:

1. A broadband antenna system comprising at least one hollow radiating element having a circumference, a radiating portion, a feed portion comprising at least two tapered feed points, and a first at least one operating structure connected to and operating said feed portion, wherein said radiating portion, said feed portion and said at least two tapered feed points are disposed coincident with said circumference, wherein said radiating portion further comprises at least two segmentations, and wherein said at least one hollow radiating element manifests the radiation characteristics of a-bicone, has at least a 2 to 1 frequency bandwidth and a radiation pattern perpendicular to said at least one hollow radiating element having a variation in gain of less than +/−6 dB, and further comprises a balun, wherein said balun is:

integrated with said radiating portion and said feed portion, and co-planar with said circumference.

2. The broadband antenna system according to claim 1, wherein said first at least one operating structure further comprises a feed line, a coaxial cable, a transmission line, a twin lead, a stripline, and a microstrip.

3. The broadband antenna system according to claim 2, further comprising:

at least one device collinear to or coaxial with said at least one hollow radiating element;

a second at least one operating structure, disposed within said at least one hollow radiating element and connected to said at least one device; and wherein said at least one device is operated by said second at least one operating structure.

4. The broadband antenna system according to claim 3, wherein said second at least one operating structure further comprises a feed line, a coaxial cable, a power cable, a digital cable, a fiber optic cable, a wire, piping, tubing, a mechanical actuator, a gas transfer system, a liquid transfer system, and a solid material transfer system.

5. The broadband antenna system according to claim 4, wherein said at least one device further comprises an antenna element, a GPS system, a camera, an IR sensor, a light, an audio device, a radar device, and a communications system.

6. The broadband antenna system according to claim 5, further comprising a plurality of said at least two tapered feed points, and wherein the circumferential distance between each of said plurality of said at least two tapered feed points and an adjacent feed point is less than ½ wavelength of the highest frequency of operation.

7. The broadband antenna system according to claim 2, further comprising a center pipe disposed within said circumference, wherein said first at least one operating structure is routed through said center pipe.

8. The broadband antenna system according to claim 4, further comprising a center pipe disposed within said circumference, wherein said first at least one operating structure and said second at least one operating structure are routed through said center pipe.

9. A broadband antenna system comprising at least one hollow radiating element having a radiating portion with a first circumference, a substantially cylindrical feed portion with a second circumference and comprising at least two tapered feed points, a first at least one operating structure connected to and operating said feed portion, wherein said at least two tapered feed points are disposed substantially on said second circumference of said substantially cylindrical feed portion, wherein said radiating portion further comprises at least two segmentations, and wherein said at least one hollow radiating element manifests the radiation characteristics of a bicone, has at least a 2 to 1 frequency bandwidth and a radiation pattern perpendicular to said at least one hollow radiating element having a variation in gain of less than +/−6 dB, and further comprises a balun, wherein said balun is:

integrated with said radiating portion and said feed portion, and co-planar with at least one of said first circumference and said second circumference.

10. The broadband antenna system according to claim 9, wherein said first at least one operating structure further comprises a feed line, a coaxial cable, a transmission line, a twin lead, a stripline, and a microstrip.

11. The broadband antenna system according to claim 10, further comprising:

at least one device collinear to or coaxial with said at least one hollow radiating element;

a second at least one operating structure, disposed within said at least one hollow radiating element and connected to said at least one device; and wherein said at least one device is operated by said second at least one operating structure.

12. The broadband antenna system according to claim 11, wherein said second at least one operating structure further comprises a feed line, a coaxial cable, a power cable, a digital cable, a fiber optic cable, a wire, piping, tubing, a mechanical actuator, a gas transfer system, a liquid transfer system, and a solid material transfer system.

13. The broadband antenna system according to claim 12, wherein said at least one device further comprises an antenna element, a GPS system, a camera, an IR sensor, a light, an audio device, a radar device, and a communications system.

14. The broadband antenna system according to claim 13, further comprising a plurality of said at least two tapered feed points, and wherein the circumferential distance between each of said plurality of said at least two tapered feed points and an adjacent feed point is less than ½ wavelength of the highest frequency of operation.

15. The broadband antenna system according to claim 10, further comprising a center pipe disposed within said circumference, wherein said first at least one operating structure is routed through said center pipe.

16. The broadband antenna system according to claim 12, further comprising a center pipe disposed within said circumference, wherein said first at least one operating structure and said second at least one operating structure are routed through said center pipe.

17. The broadband antenna system according to claim 5, wherein a combination of a plurality of said at least one hollow radiating element and a plurality of said at least one device permits operation over an expanded second frequency bandwidth.

18. The broadband antenna system according to claim 13, wherein a combination of a plurality of said at least one hollow radiating element and a plurality of said at least one device permits operation over an expanded second frequency bandwidth.

* * * * *